United States Patent [19]

Garner et al.

[11] 4,020,299

[45] Apr. 26, 1977

[54] ELECTRO-ACOUSTIC TRANSDUCER DIAPHRAGMS

[75] Inventors: Alex Victor Garner, Leeds; Graham Townsend, Shipley, both of England

[73] Assignee: The Rank Organisation Limited, London, England

[22] Filed: May 19, 1975

[21] Appl. No.: 578,916

Related U.S. Application Data

[63] Continuation-in-part of Ser. No. 479,495, June 14, 1974, abandoned.

[30] Foreign Application Priority Data

June 16, 1973 United Kingdom ..... 28732/73

[52] U.S. Cl. ..... 179/181 R; 179/180; 181/166

[51] Int. Cl.[2] ..... H04R 7/02

[58] Field of Search ..... 179/181 R, 115 R, 180; 181/164, 173, 157, 170, 184, 166

[56] References Cited

UNITED STATES PATENTS

| | | | |
|---|---|---|---|
| 982,027 | 1/1911 | Young | 181/157 X |
| 1,097,499 | 5/1914 | Young | 181/157 X |
| 1,560,552 | 11/1925 | Esterbrook | 181/164 |
| 1,673,661 | 6/1928 | Brigham | 179/181 R |
| 3,093,207 | 6/1963 | Bozak | 181/167 X |

*Primary Examiner*—Thomas W. Brown
*Attorney, Agent, or Firm*—Brisebois & Kruger

[57] ABSTRACT

An electro-acoustic transducer having a sound-generating diaphragm and means for driving the diaphragm in which the diaphragm is provided with perforations filled with damping material to oppose the formation of standing waves in the diaphragm. The perforations are arranged in between three and eight generally radially extending curved bands, each band being formed of a plurality of parallel rows of perforations extending along the length of the band.

8 Claims, 4 Drawing Figures

ELECTRO-ACOUSTIC TRANSDUCER DIAPHRAGMS

This is a continuation-in-part of Ser. No. 479,495, filed June 14, 1974, now abandoned.

BACKGROUND OF THE INVENTION

This invention relates to electro-acoustic transducers. It is widely known that the most faithful acoustic reproduction of sounds, whether derived from recorded or broadcast signals, is obtained from transducers having acoustically stiff diaphragms which move as a piston, that is all parts of the diaphragm move together and there is no relative movement of one part of the diaphragm with respect to any other. This is very difficult to achieve in practice, however, and most diaphragms have some point in their operating range where they "break up" that is various parts start to vibrate at frequencies other than that or those at which the remainder of the diaphragm is vibrating, this is particularly the case when a transducer such as a loudspeaker is fed with a complex electrical signal containing a wide range of frequencies.

The present invention is particularly adapted for use in connection with loudspeakers of the type comprising a coil connected mechanically to the apex of a rigid conical diaphragm and moving in the magnetic field produced by a permanent magnet when fed with electrical signals representing the acoustic sounds which transducer is to reproduce.

In greater detail, optimum transformation from the mechanical energy of movement in the diaphragm to acoustic sound energy in the air occurs when the diaphragm moves as a whole, that is, when the relative movement of each portion of the cone with respect to any other portion thereof is zero. Because of the physical nature of the diaphragm and the wide range of frequencies of oscillation which the diaphragm has to reproduce, for example from 10 Hz to 40kHz, loudspeaker cones move as pistons only over a certain restricted part of the wide frequency range required for optimum transmission of electric to acoustic energy; the particular part of the frequency range being determined to some extent by the physical dimensions of the diaphragm.

At frequencies above a certain characteristic frequency the mechanical energy produced by the coil generates a wavefront in the structure of the cone or diaphragm which travels outwards longitudinally through the body of the diaphragm in a similar manner to ripples in water generated by a stone. The energy in the wavefront thus travels radially along the cone from the moving coil to the cone mouth which is supported by a cone surround. When the wavefront arrives at the cone mouth it encounters a discontinuity in the medium through which it is propagating. This discontinuity is either caused by the cone surround being of a different material or, if the cone surround is made from the same material as the cone, because corrugations have been introduced. If the cone mouth is held directly onto, say, the support frame of the loudspeaker, then this also presents a discontinuity in the propagating medium of the travelling wavefront. It is well-known that if a wavefront in a propagating medium encounters a discontinuity, then some of the energy in the wavefront will be dissipated at the discontinuity and some will be reflected back again, the precise direction of the reflected energy being dependent on the geometry of the propagating medium and the discontinuity. When multiples and sub-multiples of the wavelength of the frequency of energy in the wavefront coincide with the distance from the source of the energy i.e. the moving coil, to the discontinuity of the cone mouth i.e. the cone surround or cone mouth support, then the energy is reflected backwards and a standing wave is formed. This gives rise to an undesirable resonance or storage of energy and a marked change in the transformation of mechanical to acoustic energy occurs. This gives rise to colourations, or distortions in the transfer of energy from the coil to sounds heard by the ear.

The above mentioned break-up point comes when standing waves are set up in the cone. If the amplitude of oscillation of various parts of the cone surface is observed, for example by taking holograms with monochromatic light, the break-up patterns are seen to form variously shaped surfaces such as circumferential concentric rings, with perhaps a number of radial triangular shaped areas, adjacent areas, or concentric rings moving in opposite directions.

The severity of the standing wave patterns and the frequencies at which they occur depend on a number of factors, for example, the overall physical size of the diaphragm, that is the diameter at the largest point, the propagation characteristics of the material of which the cone is made, and the manner in which the cone mouth is supported. Of these the propagation characteristics of the cone material and the manner in which the mouth of the cone is supported are both extremely important.

Theoretically, of course, the propagation characteristics of the cone material can be selected such that, together with the characteristics of the mounting of the mouth of the cone, all the energy travelling radially from the moving coil through the body of the diaphragm is dissipated at the junction of the cone and the mount. If this condition is achieved then the cone is said to be critically terminated. More precisely the cone and surround may be viewed as an acoustic version of the electrical transmission line analogy. If the surround presents an acoustic impedance to the travelling wavefront, equal to the characteristics acoustic impedance of the cone, then no reflection will occur at the cone edge and no standing wave patterns will be set up.

In practice, however, the choice of suitable materials for the cone and cone mounting is limited by practical considerations, so that this ideal arrangement is very difficult to achieve.

The present invention relates to alternative methods of limiting or avoiding standing waves by modification of the propagation characteristics of the material from which the cone is made. It is known that the frequency response characteristics of a diaphragm can be improved by forming a plurality of holes or perforations in a diaphragm. Previous attemps attempts achieve such improvement, however, have been confined to the rather empirical formation of holes arranged in circles centered on the center of the diaphragm, apart from one attempt in which a single curved row of rather large holes was formed to a logarithmic curve or an involute curve. An attempt to achieve the same result was also made by forming a logarithmically curved ridge on the diaphragm. These attempts were not entirely successful, however, since insufficient attention was paid to the precise configuration, location and size of the perforations which are essential if the required effect is to be achieved.

It is also known to introduce plugs of a damping material into the holes in a diaphragm to provide further control over the formation of standing waves, but again completely satisfactory results have not been obtained.

SUMMARY OF THE INVENTION

According to the present invention there is provided an electro acoustic transducer of the type having a diaphragm for the generation of sound, and drive means for the diaphragm in which the diaphragm is provided with perforations filled with a damping material to oppose the formation of standing waves and these perforations are located in at least three equally spaced bands extending substantially radially with respect to a common central point and curved in the same sense, at least at the radially outer ends of the band, through a predetermined angle, each band being formed of a plurality of rows of perforations extending along the length of the band.

Further features and advantages of the invention will become apparent during the course of the following description in which reference is made to the accompanying drawings, and which is provided purely by way of non-restrictive example.

DESCRIPTION OF THE PREFERRED EMBODIMENT

Figure 1:
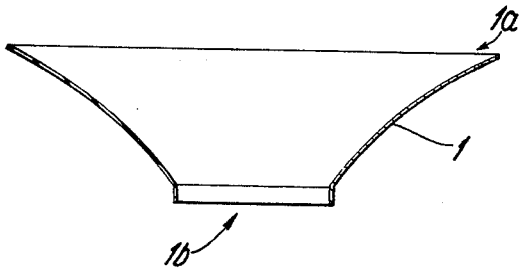
FIG. 1 shows a cross-sectional view of a loudspeaker cone.

FIG. 1 illustrates the general form of a cone 1 for a conical diaphragm loudspeaker. The cone has a wide mouth 1*a* around which it is supported for movement axially. The narrow end of the cone 1*b* forms a small aperture to which a voice coil (not shown) is attached. In the usual way the voice coil is carried in the magnetic field of a permanent magnet (not shown) and causes oscillation of the diaphragm when a suitable exciting current signal is fed thereto.

A suitable material for the diaphragm 1 is a felted or fibrous material such as paper. Alternatively a thermoplastic material may be used. A particularly good material for this use is a rubber modified styrene which can be vacuum formed into a three dimensional shape. The thickness of such a diaphragm would be in the region of 0.2 – 0.4mm.

Figure 2:
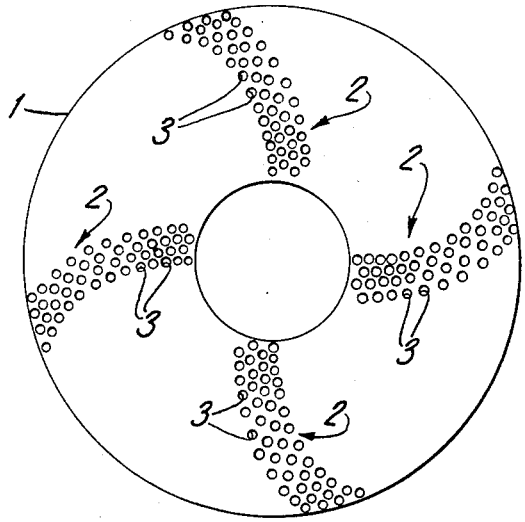
FIG. 2 shows a plan view of the same cone.

As shown in FIG. 2 the cone 1 is provided with four substantially radial bands 2 of perforations 3. The four bands are equally angularly spaced around the diaphragm 1. More or less bands may be provided if required. It has been found that the smallest number at which the desired effect is satisfactorily achieved is three bands and the greatest useful number is eight. However many bands there are they should be equally angularly spaced around the diaphragm as are the four bands 2 shown in FIG. 2.

Figure 3:
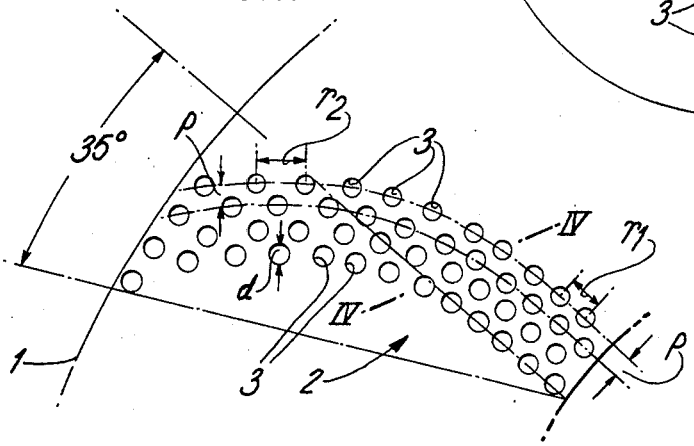
FIG. 3 shows a detail of FIG. 2 on an enlarged scale.

Each band 2 of perforations 3 comprises four rows of perforations 3 each row extending longitudinally of the band 2. As will be appreciated more clearly from FIG. 3 the pitch p, of the rows, that is the separation of one row from another across the band 2 is constant along the length of the band, and the spacing $r$ of the perforations in a row increases towards the periphery of the diaphragm. Thus the spacing $r_1$ of two perforations close to the centre of the diaphragm, both perforations lying in the same row of the band 2 shown in FIG. 3, is smaller than the spacing $r_2$, of two perforations in the same row but adjacent to outer periphery of the diaphragm.

The diameters of the perforations 3 in the band are between 0.01% and 0.02% of the outer diameter of the periphery of the diaphragm. The rows of perforations are curved through about 35° along the length of the band, being exactly radially disposed at the inner ends thereof and inclined through about 35° to this line at the outer end thereof.

Figure 4:
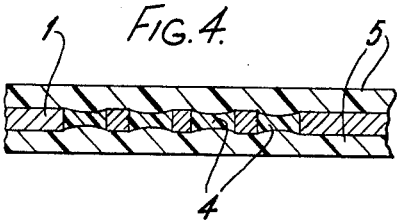
FIG. 4 is a cross section taken on the line IV—IV of FIG. 3.

The perforations 3 are filled with a damping material 4 made of a p.v.a. based compound having a high internal energy absorption. Such damping compounds are known in the loudspeaker art for treating the cone edge support or cone surround. In practice the perforations 3 in the diaphragm are filled with the compound 4 in a liquid state and the natural surface tension of the compound 4 in its liquid state keeps the holes filled until the solvent evaporates and the compound 4 then lies in the holes where it remains effective during the operation of the loudspeaker. A further coating 5 of damping material over the whole of the diaphragm, including the damping compound 4 in the perforations, is then applied to form a construction as illustrated in FIG. 4.

Although the invention has been described in relation to a particular moving coil loudspeaker with a conical diaphragm it has application in all forms of electro-acoustic transducers where problems of standing waves are encountered. The number of perforations 3 in each row and the number of rows in each band may be varied to suit the particular effect desired.

The pattern of holes described and the visco elastic damping compound substantially reduces the amplitude of the break up mode in such a way as to minimise the distorted sound effects at the ear. The symmetrical arrangement of the groups of holes and the homogeneous nature of the cone body and damping layer all combine to give break up patterns in the working range of the diaphragm which are substantially axisymmetric nodal circles. This type of break up is to be preferred in loudspeakers rather than random areas of localised break up where independent areas of the cone can radiate independently and so distort the sound field markedly.

We claim:

1. In an electro-acoustic transducer of the type having a diaphragm for the generation of sound and drive means for the diaphragm, and wherein said diaphragm is provided with perforations filled with a damping material having a high level of internal energy absorption to oppose the formation of standing waves in the diaphragm, the improvement wherein said perforations are located in at least three equally spaced bands extending substantially radially with respect to a common central point and curved in the same direction, at least at the radially outer ends of the band, through a predetermined angle, and wherein the perforations in each band are located in a plurality of parallel rows extending along the length of the band.

2. The improvement in an electro-acoustic transducer as in claim 1, wherein all said rows of perforations are separated from their neighbouring rows by substantially the same pitch.

3. The improvement in an electro-acoustic transducer as in claim 1, wherein said bands of perforations are curved through substantially 35° from one end to the other, the radially inner end of each band being radial with respect to said common point.

4. The improvement in an electro-acoustic transducer as in claim 1, wherein the spacing of adjacent perforations in any one row is greater in that part of said row further from said common point than in that part of said row nearer said common point.

5. The improvement in an electro-acoustic transducer as in claim 1, wherein said diaphragm is substantially conical.

6. The improvement in an electro-acoustic transducer as in claim 5, wherein the size of said perforations is from 0.01% to 0.02% of the diameter of the cone mouth of said diaphragm.

7. The improvement in an electro-acoustic transducer as in claim 1, wherein there are not more than eight bands of perforations in said diaphragm.

8. The improvement in an electro-acoustic transducer as in claim 1, wherein there is a further coating of damping material covering the whole of said diaphragm, said further coating of damping material filling said perforations in said diaphragm.

* * * * *